United States Patent [19]

Tanae et al.

[11] Patent Number: 4,905,468

[45] Date of Patent: Mar. 6, 1990

[54] FALSE TWISTER

[75] Inventors: Fumio Tanae, Iyo; Shunzo Naito, Matsuyama; Hirokazu Matsuoka, Matsuyama; Shigeru Yamamoto, Matsuyama; Norio Yoshinouchi, Matsuyama, all of Japan

[73] Assignee: Teijin Seiki Company Limited, Osaka, Japan

[21] Appl. No.: 308,516

[22] Filed: Feb. 10, 1989

[30] Foreign Application Priority Data

Feb. 22, 1988 [JP] Japan ..... 63-40261

[51] Int. Cl.[4] ..... D02G 1/02

[52] U.S. Cl. ..... 57/291; 57/284; 57/290

[58] Field of Search ..... 57/284, 287, 288, 290, 57/291

[56] References Cited

U.S. PATENT DOCUMENTS

| | | | |
|---|---|---|---|
| 4,223,519 | 9/1980 | Konig et al. | 57/291 |
| 4,362,010 | 12/1982 | Crouzet | 57/291 X |
| 4,362,011 | 12/1982 | Kikuchi | 57/291 |
| 4,395,872 | 8/1983 | Riedl | 57/290 X |
| 4,719,745 | 1/1988 | Konig | 57/284 X |
| 4,726,180 | 2/1988 | Naylor et al. | 57/284 X |
| 4,809,494 | 3/1989 | Dammann | 57/291 |

*Primary Examiner*—John Petrakes

*Attorney, Agent, or Firm*—Lane & Aitken

[57] ABSTRACT

A false twisting apparatus comprising: a pair of first feed rollers for feeding a yarn to be false twisted; a pair of second feed rollers for feeding a false-twisted yarn; a first heating means and a twisting means which are provided between the first and second feed rollers in order to false twist the yarn fed by the first feed rollers; wherein first and second stabilizing means for cooling and stabilizing the yarn heated by the first heating means are arranged between the first heating means and the twisting means in the recited order; the first stabilizing means being arranged substantially aligned with the first heating means; an interior angle defined between the first and second stabilizing means and inside the apparatus being more than 90°; and the length of the second stabilizing means being shorter than that of the first stabilizing means.

13 Claims, 2 Drawing Sheets

FALSE TWISTER

FIELD OF THE INVENTION

The present invention relates to an improvement in a false twisting apparatus, and more particularly to an improved false twisting apparatus or draw texturing apparatus which inhibits surging phenomenon at the time of high-speed false twist treatment (phenomenon wherein a severe fluctuation of tension occurs in a travelling yarn at a false twisting zone) and which is capable of false twist treatment at high speeds.

DESCRIPTION OF THE PRIOR ART

Recently, as false twisting apparatuses are operated at high speeds, the heating unit and cooling unit employed therein have been made longer to prevent the reduction in heat setting performance. Consequently, there occurs the problem that the installation becomes huge. In order to overcome such problem, false twisting apparatuses have been proposed wherein various attempts are made in the arrangement of the heating unit and cooling unit. For example, as shown in FIGS. 2 through 4, in the false twisting apparatuses wherein a first heating unit 3 and a twisting unit 4 are provided between a pair of firt feed rollers 1 and a pair of second feed rollers 2, a first cooling plate 5 and a second cooling plate 6 are arranged between the first heating unit 3 and the twisting unit 4.

However, since in the apparatus shown in FIG. 2 a yarn Y heated to a high temperature with the first heating unit 3 is bent at right angles at the exit of the heating unit 3, fluffs tend to occur on the yarn Y, and further since the travelling yarn Y is bent at the two locations of the exit of the first heating unit 3 and between the first and second cooling plates 5 and 6, there is the problem that the retroaction of twist to the heating unit 3 is inhibited and the effective number of twists thus reduced. Also, since in the apparatus shown in FIG. 3 a yarn Y is bent sharply between first and second cooling plates 5 and 6, in cooperation with that, the yarn Y is folded back within a first heating unit 3, the retroaction of twist to the first heating unit 3 is retarded and the effective number of twists thus reduced. Further, since a second cooling plate 6 is relatively longer, surging phenomenon (wherein a severe fluctuation of tension occurs in a travelling yarn at a false twisting zone) occurs at relatively lower speeds, and false twist treatment under high speeds is thus difficult. Even in the apparatus shown in FIG. 4, the same problem as the case of the apparatus shown in FIG. 3 will occur, because a yarn Y bends sharply between first and second cooling plates 5 and 6, and further the second cooling plate 6 is longer.

Therefore, it is an object of the present invention to provide an improved false twisting apparatus which overcomes the problems described above and which inhibits surging phenomenon at the time of high-speed false twist treatment and which is capable of false twist treatment at high speeds.

SUMMARY OF THE INVENTION

The foregoing object is accomplished in accordance with the present invention by providing a false twisting apparatus comprising: a pair of first feed rollers for feeding a yarn to be false twisted; a pair of second feed rollers for feeding a false-twisted yarn; a first heating means and a twisting means which are provided between the first and second feed rollers in order to false twist the yarn fed by the first feed rollers; wherein first and second stabilizing means for cooling and stabilizing the yarn heated by the first heating means are arranged between the first heating means and the twisting means in the recited order; the first stabilizing means being arranged substantially aligned with the first heating means; an interior angle defined between the first and second stabilizing means and inside the apparatus being more than 90°; and the length of the second stabilizing means being shorter than that of the first stabilizing means.

Since in accordance with the present invention the first stabilizing means is arranged substantially aligned with the first heating means, the yarn heated with the first heating means is not curved at the exit of the first heating means, and therefore there are no occurrence of fluffs and no retardation of retroaction of twist. In addition, since the interior angle defined between the first and second stabilizing means is more than 90°, the curvature to which the yarn is subjected is small and therefore there are no retardation of retroaction of twist and no reduction in the effective number of twists. Further, since the length of the second stabilizing means is shorter than that of the first stabilizing means, an occurrence of surging phenomenon can be inhibited. Also, even if the tension fluctuation of the yarn occurs in the substantially linear zone defined by the first heating means and the first stabilizing means, the tension fluctuation can be prevented from be transmitted to the twisting means. Consequently, the twisting tension to be applied to the yarn is stabilized and the occurrence of surging phenomenon thus inhibited.

The interior angle defined between the first and second stabilizing means may also be between 90° and 140°. In this case, the apparatus according to the subject invention has its advantage in that the size thereof becomes compact, since the height and width of the apparatus can be made smaller as compared with the prior art apparatus. The greater the interior angle, the better the retroaction of twist. However, as the interior angle is increased, the speed at which the surging phenomenon occurs will be reduced. Consequently, the false twist treatment cannot be performed at high speeds. Accordingly, it is most preferable that, in the false twist treatment at high speeds of 1000 to 1200 m/min or over, the interior angle be between 90° and 140°.

Further, the total length of first and second stabilizing means may also be not more than 1400 mm, since the yarn is sufficiently cooled in the false twist treatment at high speeds of more than 1000 m/min if the total length is not more than 1400 mm. In the case where the total length is more than 1400 mm, the speed at which the surging phenomenon occurs is decreased.

Further, the first heating means may also be of non-contact type and have a heating temperature higher than a melting point of said yarn. In this case, the speed at which the surging phenomenon occurs can be increased since the length of the first heating means can be made shorter. Consequently, the apparatus according to the subject invention can be made smaller.

BRIEF DESCRIPTION OF THE DRAWINGS

The above and other objects and advantages will become apparent from the following detailed description when read in conjunction with the accompanying drawings wherein.

DESCRIPTION OF THE PREFERRED EMBODIMENT

Figure 1:
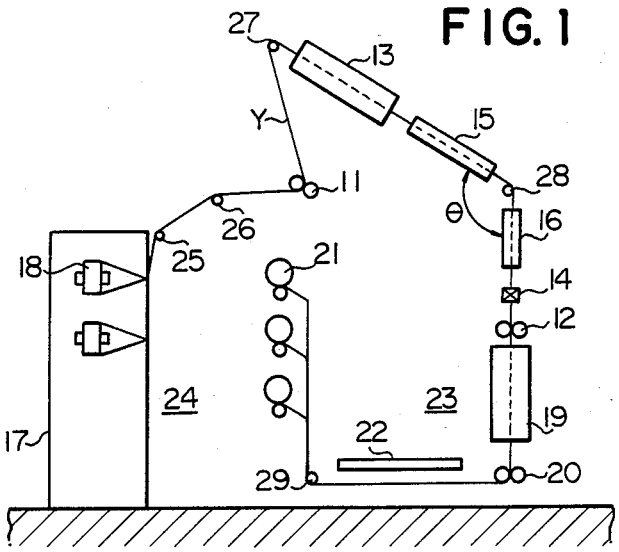
FIG. 1 is a schematic elevational view showing an embodiment of a false twisting apparatus according to the present invention.
Figure 2:
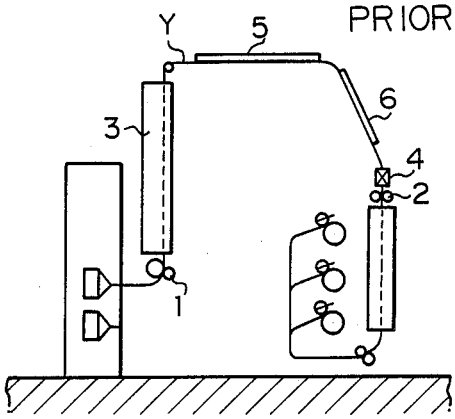
FIG. 2 PRIOR ART
FIG. 2 is a view similar to FIG. 1 showing a conventional false twisting apparatus.
Figure 3:
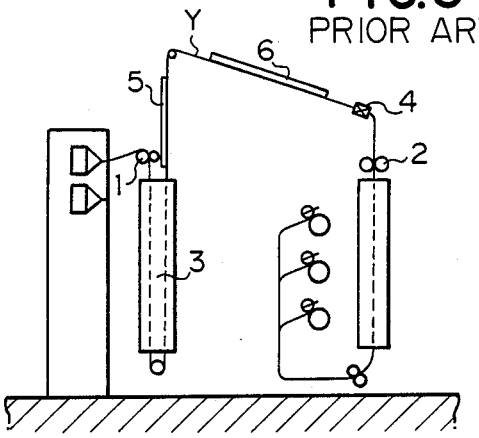
FIG. 3 PRIOR ART
FIG. 3 is a schematic elevational view illustrating another conventional false twisting apparatus.
Figure 4:
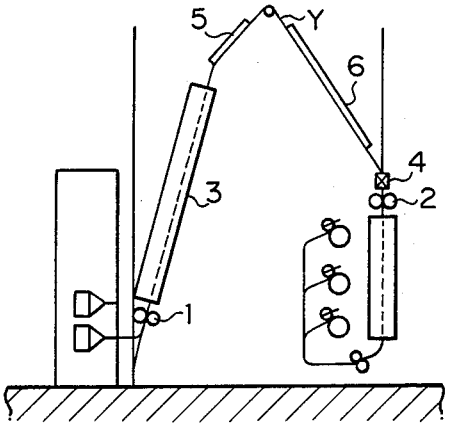
FIG. 4 PRIOR ART
FIG. 4 is a view similar to FIG. 3 illustrating still another conventional false twisting apparatus.

Referring to FIG. 1, there is shown a preferred embodiment of a false twisting apparatus or draw texturing apparatus in accordance with the present invention. Between a pair of first feed rollers 11 and a pair of second feed rollers 12 there are provided a first heating unit or means 13 and a twisting unit or means 14, and between the first heating unit 13 and the twisting unit 14 there are provided a first stabilizing track or means 15 and a second stabilizing track or means 16. The first stabilizing track 15 and second stabilizing track 16 are disposed in the recited order from the first heating unit 13. It should here be noted that the stabilizing track is one which is normally known as a cooling body or yarn-contact body.

The first stabilizing track 15 is arranged to be substantially aligned with the first heating unit 13. The reason is that if a yarn Y is curved between the first heating unit 13 and the first stabilizing track 15, the yarn Y immediately after it is heated to a high temperature with the first heating unit 13 will be subjected to curvature which causes an occurrence of fluffs and retards retroaction of twist.

In addition, the interior angle $\theta$ defined between the first and second stabilizing tracks 15 and 16 is more than 90°. In the case of the angle being less than 90°, i.e. in the case the travelling yarn Y is curved sharply, the retroaction of twist to the first heating unit 13 will be retarded and the effective number of twists thus reduced. The greater the interior angle, the better the retroaction of twist. However, as the interior angle is increased, the speed at which the surging phenomenon occurs will be reduced. Consequently, the false-twist treatment cannot be performed at high speeds. Accordingly, it is most preferable that, in the false twist treatment at high speeds of 1000 to 1200 m/min or over, the interior angle be between 90° and 140°.

Further, the length of the second stabilizing track 16 arranged adjacent the twisting unit 14 is made shorter than that of the first stabilizing track 15 arranged adjacent the first heating unit 13. The reason is that if the length of the second stabilizing track 16 immediately before the twisting unit 14 is long, the yarn rotating at high speed is greatly moved laterally on the track 16 by this force of rotation, and the twisting tension thus fluctuated, thereby causing an occurrence of surging phenomenon. It is preferable that the length of the first stabilizing track 15 be less than 1 meter, and the length of the second stabilizing track 16 be less than 0.4 meters. Further, it is preferable that the total length of the first and second stabilizing tracks 15 and 16 be less than 1400 mm. The reason is that in the case where the total length is more than 1400 mm, the speed at which the surging phenomenon occurs is decreased. It is noted that a yarn package stand is designated by 17, a yarn supply package by 18, a second heating unit or means by 19, a pair of third feed rollers by 20, a yarn take-up machine by 21, a working platform by 22, an inside working region by 23, an outside working region by 24, and guide rollers by 25, 26, 27, 28 and 29.

The yarn Y unwound from the supply package 18 mounted on the stand 17 passes over the guide rollers 25 and 26 and through a pair of the first feed rollers 11, and undergoes false twist treatment by the heating unit 13 and the twisting unit 14. The yarn Y that passed through the heating unit 13 is cooled and stabilized by the first and second stabilizing tracks 15 and 16, and then passes through a pair of the second feed rollers 12. At this time, the false twist treatment may be performed stretching the yarn Y by making the peripheral speed of the second feed rollers 12 higher than that of the first feed rollers 11. Next, the yarn is heat treated, if necessary, by the second heating unit 19, and then taken up by the yarn take-up machine 21.

It is noted that if the first heating unit 13 is of the non-contact type and the temperature thereof is more than the melting point of the yarn, the length of the first heating unit 13 can be made shorter, for example, less than 1 meter and thus the occurrence of surging phenomenon under the high-speed false twist treatment can be effectively prevented. Also, as the twisting unit 14, a friction false-twist unit is normally employed.

Since in accordance with the present invention the first stabilizing track is arranged substantially aligned with the first heating unit, the yarn heated with the first heating unit is not curved at the exit of the first heating unit, and therefore there are no occurrence of fluffs and no retardation of retroaction of twist. In addition, since the angle defined between the first and second stabilizing tracks is more than 90°, the curvature to which the yarn is subjected is small and therefore there are no retardation of retroaction of twist and no reduction in the effective number of twists. Further, since the length of the second stabilizing track is shorter than that of the first stabilizing track, an occurrence of surging phenomenon can be inhibited. Also, even if the tension fluctuation of the yarn occurs in the substantially linear zone defined by the first heating unit and the first stabilizing track, the tension fluctuation can be prevented from be transmitted to the twisting unit. Consequently, the twisting tension to be applied to the yarn is stabilized and the occurrence of surging phenomenon thus inhibited.

While the subject invention has been described with relation to the preferred embodiment thereof, various modifications and adaptations thereof will now be apparent to those skilled in the art.

What we claim:

1. A false twisting apparatus comprising:

a yarn package stand mounted substantially vertically on a floor for supplying a yarn to be false twisted;

a pair of first feed rollers for feeding said yarn to be false twisted;

a pair of second feed rollers for feeding a false-twisted yarn;

a first heating means and a twisting means provided between said first and second feed rollers in order to false twist said yarn fed by said first feed rollers, the twisting means being disposed in opposed and spaced relation to said yarn package stand;

first and second stabilizing means for cooling and stabilizing the yarn heated by said first heating means, the first and second stabilizing means being arranged between said first heating means and said twisting means in the recited order;

a yarn take-up machine disposed substantially vertically between said yarn package stand and said twisting means;

an interior angle of more than 90° defined between said first and second stabilizing means;

a first working region provided between said yarn package stand and said yarn take-up machine and below said first heating means and first stabilizing means; and a second working region provided between said yarn take-up machine and said twisting unit and below said first heating means and first stabilizing means.

2. A false twisting apparatus as set forth in claim 1, wherein the angle defined between said first and second stabilizing means is between 90° and 140°.

3. A false twisting apparatus as set forth in claim 2, wherein the length of said second stabilizing means is shorter than that of said first stabilizing means.

4. A false twisting apparatus as set forth in claim 2, wherein said first heating means is of a non-contact type and has a heating temperature higher than the melting point of said yarn.

5. A false twisting apparatus as set forth in claim 4, which further comprises a second heating means provided between said twisting unit and said yarn take-up machine.

6. A false twisting apparatus as set forth in claim 4, wherein the length of said second stabilizing means is shorter than that of said first stabilizing means.

7. A false twisting apparatus as set forth in claim 6, which further comprises a second heating means provided between said twisting unit and said yarn take-up machine.

8. A false twisting apparatus as set forth in claim 1, wherein said first heating means is of a non-contact type and has a heating temperature higher than the melting point of said yarn.

9. A false twisting apparatus as set forth in claim 8, wherein the length of said second stabilizing means is shorter than that of said first stabilizing means.

10. A false twisting apparatus as set forth in claim 1, which further comprises a second heating means provided between said twisting unit and said yarn take-up machine.

11. A false twisting apparatus as set forth in claim 10, wherein the length of said second stabilizing means is shorter than that of said first stabilizing means.

12. A false twisting apparatus as set forth in claim 1, wherein the length of said second stabilizing means is shorter than that of said first stabilizing means.

13. A false twisting apparatus as set forth in claim 1, wherein said second stabilizing means has a longitudinal axis lying at an agnle of 0° to 30° to the vertical.

* * * * *